US005524331A

United States Patent [19]

Pond

[11] Patent Number: 5,524,331

[45] Date of Patent: Jun. 11, 1996

[54] METHOD FOR MANUFACTURING GOLF CLUB HEAD WITH INTEGRAL INSERTS

[75] Inventor: Brian R. Pond, San Marcos, Calif.

[73] Assignee: Odyssey Sports, Inc., Carlsbad, Calif.

[21] Appl. No.: 294,384

[22] Filed: Aug. 23, 1994

[51] Int. Cl.[6] ..... A63B 53/04

[52] U.S. Cl. ..... 29/527.4; 264/257; 273/78; 473/342

[58] Field of Search ..... 29/527.4; 264/257; 273/78

[56] References Cited

U.S. PATENT DOCUMENTS

| | | | |
|---|---|---|---|
| 3,817,522 | 6/1974 | Simmons | 273/78 |
| 3,847,399 | 11/1974 | Raymont | 273/78 |
| 4,523,759 | 6/1985 | Igarashi . | |
| 4,581,190 | 4/1986 | Nagamoto et al. | 264/257 X |
| 4,679,792 | 7/1987 | Straza et al. | 273/78 |
| 4,740,345 | 4/1988 | Nagasaki et al. | 29/527.4 X |
| 4,991,843 | 12/1991 | Mori | 273/80.3 |
| 5,078,397 | 1/1992 | Aizawa | 273/78 |
| 5,185,914 | 2/1993 | Petruccelli et al. . | |
| 5,198,062 | 3/1993 | Chen | 156/245 |
| 5,244,211 | 9/1993 | Lukasiewicz . | |
| 5,301,941 | 4/1994 | Allen | 273/78 |
| 5,362,055 | 11/1994 | Rennie . | |

*Primary Examiner*—Carl J. Arbes

*Attorney, Agent, or Firm*—James C. Weseman; Gray Cary Ware & Freidenrich

[57] ABSTRACT

A method of manufacturing a golf club head comprising the steps of forming a head body from a metal material and forming a recess within the front face of the head body which extends rearwardly therewithin. The method further comprises the step of casting a curable, non-metal insert within the recess which is consolidated directly into and integral with the head body.

15 Claims, 1 Drawing Sheet

10
12
16
5
28
72
14
5
60
62
64

12
16
20
14
18
30
32

12
14
26
24
20
22
30

34

52
54
50
38
50
44
50
36
66
68
48
66
14
62
32
64
30
16
12
42
42
70
58
56
46
46
70
40

METHOD FOR MANUFACTURING GOLF CLUB HEAD WITH INTEGRAL INSERTS

FIELD OF THE INVENTION

The present invention relates generally to golf clubs, and more particularly to an improved golf club head having an insert disposed in the front face thereof, and a method of forming the same.

BACKGROUND OF THE INVENTION

As is well known, in becoming proficient in the game of golf, it is necessary for the golfer to consistently drive the golf ball from the tee box with distance and accuracy. In this regard, once the golfer has obtained proficiency in driving the golf ball (i.e., hitting woods), reduction in the golfer's gross score is achieved due to the resultant reduction in the length and difficulty of the subsequent shot. Although golf swings vary from golfer to golfer, a proper golf swing from the tee box entails that the driver or other wood be swung in an arcuate fashion with the momentum imparted to the golf ball by the club head being controlled by the amount of back swing as well as the impact velocity of the front face of the club head upon the golf ball.

Due to the extremely high impact velocity of the front face of the club head upon the golf ball which typically occurs when the golf ball is driven from the tee box through the use of a driver or other wood, minor variations between the orientation of the front face relative the golf ball upon impact have a significant effect on the trajectory of the golf ball. It is customary in the design of drivers and other woods to form the front face of the club head with horizontal bulge and vertical roll contours which determine the particular spin and trajectory that will be imparted to the golf ball when the same is impacted by the front face of the club head. In this respect, the bulge and roll radii dimensions are tightly controlled to make the golf club more responsive, and allow the golfer to control the rotational direction of the spin and trajectory imparted to the golf ball by selectively varying the orientation of the front face of the club head relative to the golf ball at impact. The bulge and roll radii dimensions are also controlled in certain drivers and woods to make the golf club more forgiving by creating a larger "sweet spot", or correcting for slices and/or hooks by imparting spin onto the golf ball which compensates for an improper orientation of the front face relative to the golf ball at impact.

Over recent years, the use of drivers and woods having metal club heads has become prevalent in the game of golf. These metal club heads have the same overall configuration as the older wooden club heads, but generally define a hollow interior compartment which is foam-filled. The metal club heads are typically produced via an investment casting process wherein a quantity of molten metal material is poured into a mold and about a ceramic coated wax piece disposed therein. Subsequent to the removal of the club head from within the mold, the wax is melted and drained from the club head, thus facilitating the formation of the hollow interior chamber which is defined by the now hollow ceramic shell disposed within the club head. However, due to distortion which occurs during the investment casting process, the front faces of the club heads often do not have precisely the correct bulge and roll radii dimensions. As can be appreciated, such distortion results in the production of a metal club head which does not provide the control or compensation characteristics previously discussed.

In recognition of the deficiencies associated with the production of metal club heads via the investment casting process, there has been developed in the prior art metal club heads for drivers and woods which include an extremely hard insert material disposed within the impact or front face of the club head. Typically, such insert is separately formed and subsequently adhesively bonded or mechanically fastened in a recess formed within the front face. The use of an adhesive has proven deficient, often times resulting in the hardened insert becoming dislodged due to the high impact forces exerted upon the front face of the club head. Additionally, the use of an epoxy adhesive between the hardened insert and the club head often serves to dampen the impact forces and thereby reduce the overall length of the golf shot. In this respect, gluing the pre-fabricated insert into the club head is typically less effective in transferring the load of the golf ball impact to the club head, thus resulting in the loss of feel and distance.

The present invention overcomes the deficiencies associated with prior art metal club heads for drivers and woods by providing a method of manufacturing a metal club head which incorporates a low density, high specific strength front face insert to displace weight away from the center of the club head and increase the golf club's moment of inertia, thus making it a better, more forgiving club to hit. In the present manufacturing method, the insert is consolidated directly into the front face of the club head through the utilization of a dual chamber co-curing assembly. The use of the co-curing assembly is tied to the identification and selection of special resins for the insert which flow and harden at specific points within the insert curing cycle. The present method produces a smooth, attractive outer finish for the insert which is void free. The insert is in direct contact with the metal club head, and in particular the inner surface of a recess formed in the front face thereof. The inner surface of the recess has an arcuate, generally convex configuration which increases the strength of the wall separating the recess from the hollow interior chamber of the club head, allows for the optimal utilization of the insert properties, and maximizes the club head to insert bond strength due to the larger surface area provided thereby.

SUMMARY OF THE INVENTION

In accordance with the present invention, there is provided a method of manufacturing a golf club head which comprises the step of forming a head body from a metal material (preferably stainless steel), with the head body defining a front face. The method further comprises the steps of forming a recess within the front face which extends rearwardly within the head body and preferably defines an arcuate, generally convex inner surface, and casting a curable non-metal material within the recess.

The casting step of the present method itself comprises the steps of placing a non-metal insert into the recess and curing the insert within the recess in a manner causing the same be consolidated directly into and integral with the head body. The insert is preferably a graphite-epoxy composite comprising a laminate defining a base layer and a top layer. The base layer is shaped to conform to the recess and subsequently inserted thereinto such that the base layer is in direct contact with the convex inner surface thereof. The top layer is also shaped to conform to the recess and inserted thereinto so as to overlap and cover the base layer.

To facilitate the curing of the insert, the head body is placed into a co-curing assembly which defines first and second chambers separated by a flexible membrane, and includes a molding tool movably mounted within the second chamber thereof. The head body is supported within the second chamber in a manner wherein the molding tool is positioned over the insert and spaced therefrom. For approximately the first ten minutes of the preferred curing cycle, a vacuum is pulled in the first and second chambers while the temperature within the co-curing assembly is at room temperature. For approximately the next sixty minutes of the curing cycle, the pressure in the first chamber is increased to approximately 150 psi, while the temperature within the co-curing assembly is gradually-increased from room temperature to approximately 250° F. The pressurization of the first chamber to approximately 150 psi facilitates the movement of the molding tool into direct contact with the insert. For approximately the next 120 minutes of the curing cycle, the pressure in the second chamber is increased to atmospheric pressure while the temperature within the co-curing assembly is maintained at approximately 250° F. For approximately the next 120 minutes of the curing cycle, the temperature within the co-curing assembly is gradually decreased from approximately 250° F. to room temperature. Thereafter, the pressure in the first chamber is decreased to atmospheric pressure while the temperature within the co-curing assembly is at room temperature. The depressurization of the first chamber to atmospheric pressure facilitates the movement of the molding tool out of contact with the insert.

The molding tool preferably includes raised score lines formed thereon to facilitate the formation of recessed score lines within the insert, and in particular the top layer thereof. The recessed score lines are formed in the top layer of the insert when the raised score lines of the molding tool come into direct contact therewith as occurs when the first chamber of the co-curing assembly is pressurized to approximately 150 psi. Subsequent to the curing of the insert and the removal of the head body from within the co-curing assembly, any residual flash is removed from the perimeter of the recess.

Further in accordance with the present invention, there is provided a golf club head comprising a head body defining a front face and a recess formed within the front face which extends rearwardly within the head body and defines an arcuate, generally convex inner surface. The club head further comprises an insert cast in place within the recess which is formed of material different from the material of the head body. The insert preferably comprises a graphite-epoxy composite which itself comprises a laminate defining a base layer and a top layer. Preferably formed within the top layer of the insert are a plurality of recessed score lines.

BRIEF DESCRIPTION OF THE DRAWINGS

These, as well as other features of the present invention will become more apparent upon reference to the drawings wherein.

DETAILED DESCRIPTION OF THE PREFERRED EMBODIMENT

Figures 1, 2, 3, 4, 5:
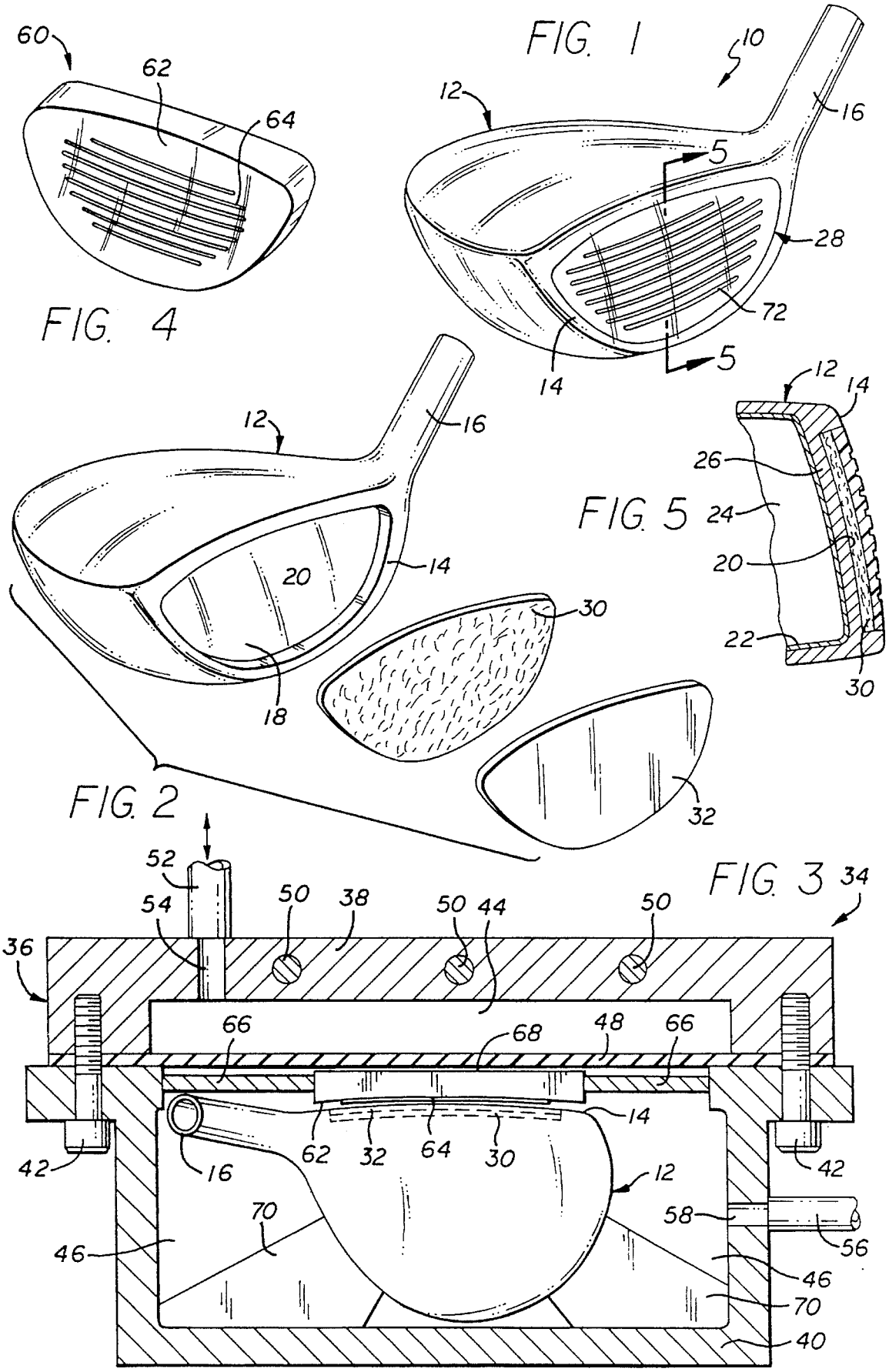
FIG. 1 is a front perspective view of a metal golf club head constructed in accordance with the present invention.
FIG. 2 is an exploded view illustrating the components of the insert incorporated into the front face of the head body of the club head.
FIG. 3 is a cross-sectional view of the co-curing assembly used to cure the insert within the head body.
FIG. 4 is a perspective view of a molding tool of the co-curing assembly.
FIG. 5 is a cross-sectional view taken along line 5—5 of FIG. 1.

Referring now to the drawings wherein the showings are for purposes of illustrating a preferred embodiment of the present invention only, and not for purposes of limiting the same, FIG. 1 perspectively illustrates a golf club head 10 which is constructed in accordance with the present invention. In the preferred embodiment, the club head 10 is configured for use as a part of a driver or other wood. However, it will be recognized that the present invention may also be practiced in relation to club heads configured for use as parts of irons.

Referring now to FIGS. 1, 2 and 5, the club head 10 comprises a head body 12 which is formed from a metal material, and preferably stainless steel. The head body 12 defines a front face 14 and a tubular, upwardly extending neck portion 16 which is attachable to a conventional golf club shaft (not shown). Formed within the front face 14 is a recess 18 which extends rearwardly within the head body 12. As best seen in FIGS. 2 and 5, the recess 18 preferably defines an arcuate, generally convex inner surface 20.

The head body 12 is preferably produced via an investment casting process wherein a quantity of molten stainless steel material is poured into a mold and about a ceramic coated wax piece disposed therein. Subsequent to the removal of the club head 10 from within the mold, the wax is melted and drained from the club head 10 via the tubular neck portion 16 thereof. A hollow ceramic shell 22 which defines an interior chamber 24 remains within the club head 10 upon the removal of the wax therefrom. The interior chamber 24 is then typically filled with foam via the neck portion 16. Advantageously, the formation of the recess 18 with a convex inner surface 20 increases the strength of the wall 26 separating the inner surface 20 of the recess 18 from the interior chamber 24.

The club head 10 constructed in accordance with the present invention further comprises a curable non-metal insert 28 which is cast in place within the recess 18 of the club head 10 in a manner which will be described in more detail below. As best seen in FIGS. 2 and 5, the insert 28, prior to being cured, preferably comprises a graphite-epoxy laminate which defines a base layer 30 and a top layer 32. The base layer 30 preferably comprises an epoxy saturated or impregnated carbon fiber sheet such as that which is available from the Hexel Corporation, Composite Division of Pleasanton, Calif., as Product No. TSRN-150-XX-F185. The top layer 32 comprises a void free epoxy impregnated carbon fiber sheet. In accordance with the present invention, the insert 28 is cured within the recess 18 in a manner causing the same to be consolidated directly into an integral with the head body 12.

The casting of the insert 28 into the recess 18 is accomplished by initially shaping the base layer 30 to conform to the recess 18, and subsequently inserting the base layer 30 into the recess 18 such that the base layer 30 is in direct contact with the inner surface 20 thereof. The top layer 32 is then shaped to conform to the recess 18 and subsequently inserted thereinto. When inserted into the recess 18, the top layer 32 overlaps and covers the previously inserted base layer 30. As further seen in FIG. 5, the base and top layers 30, 32, when inserted into the recess 18, have a combined thickness which is approximately equal to the depth of the recess 18. As such, the exposed surface of the top layer 32 is substantially continuous with the front face 14 of the head body 12. Additionally, due to the formation of the inner surface 20 of the recess 18 with a convex configuration, the exposed surface of the top layer 32 assumes an arcuate, outwardly bowed configuration.

Referring now to FIG. 3, subsequent to the insertion of the base and top layers 30, 32 into the recess 18, the head body 12 is placed into a co-curing assembly 34. The co-curing assembly 34 comprises a housing 36 which includes a top housing half 38 and a bottom housing half 40 rigidly attached to each other via a pair of fasteners 42 such as bolts. The housing 36 defines a first chamber 44 and a second chamber 46 which are separated by a flexible membrane 48, the peripheral edge of which is rigidly captured between the top and bottom housing halves 38, 40. Disposed within the top housing half 38 adjacent the first chamber 44 are a plurality of heating elements 50. Additionally, attached to the top housing half 38 is a first tubular flow line 52 which communicates with the first chamber 44 via a first passage 54 extending through the top housing half 38. Similarly, attached to the bottom housing half 40 is a second tubular flow line 56 which communicates with the second chamber 46 via a second passage 58 extending through the bottom housing half 40.

Mounted within the second chamber 46 of the co-curing assembly 34 is a molding tool 60. As best seen in FIGS. 3 and 4, the molding tool 60 has an overall configuration similar to that of the recess 18, and defines a generally concave lower surface 62 having a plurality of raised score lines 64 formed thereon which are of different lengths and extend in spaced, parallel relation. The molding tool 60 is suspended within the second chamber 46 by a pair of resilient support bands 66 which extend between opposed sides of the molding tool 60 and the inner surfaces of two vertical side walls of the bottom housing half 40. When mounted within the second chamber 46 via the support bands 66, the molding tool 60 is oriented centrally between the vertical side walls of the bottom housing half 40. Additionally, the top surface 68 of the molding tool 60 extends in substantially parallel relation to the flexible membrane 48 and is separated therefrom by only a narrow gap.

In addition to the molding tool 60, disposed within the second chamber 46 are a pair of club head support members 70. When the head body 12 is placed upon the support members 70, the recess 18 formed within the front face 14 thereof is directed upwardly and is disposed in a generally horizontal orientation. Importantly, the support members 70 are sized and configured to support the head body 12 (including the uncured insert 28 disposed within the recess 18 thereof) centrally within the second chamber 46 in a manner wherein the lower surface 62 of the molding tool 60 is positioned over the top layer 32 of the insert 30 and a portion of the front face 14, with only a narrow gap being defined therebetween. As further seen in FIG. 3, when the head body 12 is placed into the second chamber 46 and positioned upon the support members 70 in the proper manner, the concave contour of the lower surface 62 of the molding tool 60 is substantially complimentary to the convex contour of the exposed surface of the top layer 32 of the insert 28. As will be recognized, the attachment of the top housing half 38 to the bottom housing half 40 via the fasteners 42 occurs subsequent to the placement of the head body 12 (including the uncured insert 28 disposed within the recess 18 thereof) upon the support members 70 within the second chamber 46.

Once the head body 12 is placed into the second chamber 46 in the aforementioned manner and the top housing half 38 attached to the bottom housing half 40, the process of curing the insert 28 within the recess 18 is initiated creating a vacuum in the first and second chambers 44, 46 while the temperature within the housing 36 is at room temperature. In this respect, to create the vacuum in the first chamber 44, air is drawn therefrom via the first passage 54 and first flow line 52. Simultaneously with the evacuation of air from within the first chamber 44, the air is drawn from within the second chamber 46 via the second passage 58 and second flow line 56. As will be recognized, the simultaneous evacuation of air from within the first and second chambers 44, 46 does not cause any displacement of the flexible membrane 48 or molding tool 60. This first stage of the curing cycle wherein the vacuum is maintained in the first and second chambers 44, 46 is preferably conducted for approximately ten minutes.

After the ten minute interval comprising the first stage of the curing cycle has elapsed, the pressure in the first chamber 44 is increased to approximately 150 psi while the temperature within the first chamber 44 is gradually increased from room temperature to approximately 250° F. To pressurize the interior chamber 44, air is pumped thereinto via the first flow line 52 and first passage 54. The temperature increase in the first chamber 44 is facilitated by the activation of the heating elements 50 disposed within the top housing half 38 of the housing 36. As the pressure in the first chamber 44 is increased to approximately 150 psi, the vacuum is maintained within the second chamber 46. The resultant pressure differential between the first and second chambers 44, 46 causes the flexible membrane 48 to move against the top surface 68 of the molding tool 60. Due to the resiliency of the support bands 66 used to suspend the molding tool 60 within the second chamber 46, the movement of the flexible membrane 48 in turn pushes the molding tool 60, and in particular the lower surface 62 thereof, into direct contact with the exposed surface of the top layer 32 of the insert 28. Despite the vacuum within the second chamber 46, heat is transferred from the first chamber 44 to the insert 28 via the flexible membrane 48 and molding tool 60 which are maintained in constant contact with each other. Advantageously, the pressure within the first chamber 44 acts uniformly against the flexible membrane 48, thus resulting in the pressure applied to the insert 28 by the molding tool 60 being uniform along the entire surface area of the insert 28. The rise in temperature within the first chamber 44 to approximately 250° F. eventually results in the softening of the insert 28. When such softening occurs, the pressure of the molding tool 60 against the insert 28 causes the raised score lines 64 formed on the lower surface 62 thereof to become embedded within the top layer 32, thus facilitating the formation of recessed score lines 72 therewithin. This second stage of the curing wherein the first chamber 44 is maintained in its pressurized state while the second chamber 46 is maintained in a vacuum is preferably conducted for approximately 60 minutes.

After the 60 minute interval comprising the second stage of the curing cycle has elapsed (i.e., a total elapsed time of approximately 70 minutes from the start of the curing cycle), the pressure in the second chamber 46 is increased to atmospheric pressure, while the temperature within the first chamber 44 is maintained at approximately 250° F. The pressurization of the second chamber 46 is accomplished by pumping air thereinto via the second flow line 56 and second passage 58. As will be recognized, the increase in the pressure within the second chamber 46 to atmospheric pressure substantially decreases the force exerted against the insert 28 by the molding tool 60. However, due to the presence of air within the second chamber 46, the temperature therewithin is increased to approximately 250° F. by the transfer of heat from the first chamber 44 thereinto via the flexible membrane 48. The increase of the temperature within the second chamber 46 to approximately 250° F. facilitates an increase in the temperature of the metal head body 12 to substantially the same level. Advantageously, the transmission of heat to the insert 28 via the molding tool 60 as well as the head body 12 causes the same to soften (i.e., flow) in a manner wherein the base and top layers 30, 32 thereof become integral with each other and with the head body 12. As the insert 28 is being consolidated into the head body 12 during this third stage of the curing cycle, the raised score lines 64 of the molding tool 60 remain embedded within the insert 28. The third stage of the curing cycle wherein the first chamber 44 is pressurized to approximately 150 psi while the second chamber 46 is pressurized to atmospheric pressure is preferably conducted for approximately 120 minutes.

After the 120 minute interval comprising the third stage of the curing cycle has elapsed (i.e., a total elapsed time of approximately 190 minutes from the start of the curing cycle), the temperature within the housing 36 is gradually decreased from approximately 250° F. to room temperature. While such temperature decrease occurs, the pressure in the first chamber 44 is maintained at approximately 150 psi, while the pressure within the second chamber 46 is maintained at atmospheric pressure. As will be recognized, the decrease in temperature within the first and second chambers 44, 46 of the housing 36 to room temperature results in the gradual hardening of the insert 28 within the head body 28. This fourth stage of the curing cycle wherein the temperature is gradually decreased is preferably conducted for approximately 120 minutes. In this respect, upon the completion of the fourth stage of the curing cycle, the temperature within the housing 36, and in particular the first and second chambers 44, 46 thereof, is approximately room temperature.

After the 120 minute interval comprising the fourth stage of the curing cycle has elapsed (i.e., a total elapsed time of approximately 310 minutes from the start of the curing cycle), the pressure in the first chamber 44 is decreased from approximately 150 psi to atmospheric pressure while the temperature within the housing 36 is at room temperature. The depressuration of the first chamber 44 is accomplished by venting air therefrom via the first passage 54 and first flow line 52. Due to the previous increase of the pressure within the second chamber 46 to atmospheric pressure, the decrease in pressure in the first chamber 44 to atmospheric pressure facilitates a pressure equalization within the housing 36, thus resulting in the flexible membrane 48 returning to its original, unflexed orientation within the housing 36. The return of the flexible membrane 48 to its original orientation in turn results in the resilient return of the molding tool 60 to its original orientation, and hence the movement thereof out of contact with the insert 28. Due to the insert 28 having hardened considerably during the fourth stage of the curing cycle, the recessed score lines 72 remain defined therewithin despite the movement of the molding tool 60 out of direct contact therewith. Thereafter, the top housing half 38 is detached from the bottom housing half 40, and the golf club head 20 removed from therewithin.

During the curing cycle within the co-curing assembly 34, the pressure exerted against the top layer 32 of the insert 28 by the molding tool 60 typically causes a small amount of epoxy to flow over the front face 14 along the perimeter of the recess 18. As such, subsequent to the removal of the club head 10 from within the co-curing assembly 34, the residual flash formed by the cured epoxy is removed from the perimeter of the recess 18 via conventional sanding methods. Thereafter, the interior chamber 24 of the club head 10 is filled with foam via the tubular neck portion 16, with a club shaft subsequently being attached thereto.

Advantageously, during the aforementioned curing cycle, the insert 28 is consolidated directly into the head body 12 without the utilization of mechanical fasteners or adhesives. Thus, the disadvantages attendant to the use of adhesives as previously discussed are overcome with the present club head 10. Additionally, since pressure is uniformly applied to the insert 28 by the molding tool 60 during the curing cycle, the bulge and roll radii dimensions of the insert 28 are precisely controlled, with little or no distortion resulting during the curing cycle. Importantly, the bond strength of the insert 28 within the head body 12 subsequent to the curing thereof is maximized by the convex configuration of the inner surface 20 of the recess 18 due to the larger surface area provided thereby.

It will be recognized that the method of curing the insert 28 within the head body 12 may be practiced with pressurization levels, temperature levels, and time intervals varying from those previously set forth in relation to the preferred curing cycle. Additionally, though the insert 28 is preferably fabricated from the graphite-epoxy laminate, it will be recognized that alternative ambient temperature resins, ultra-violet curable resins, thermal-setting polymers, and/or thermal-plastic polymers may be utilized for the insert 28. In this regard, the present invention contemplates the use of differing inserts 28 to in effect, modify the feel and operating characteristics of the club head 10. When desired, more resilient polymer materials can be utilized for the insert 28. Alternatively, when desired, more hard materials can be utilized to enable customized performance characteristics. As previously explained, due to the insert 28 being integrally formed (i.e., cast or molded in place) within the head body 10, no hydraulic cushioning occurs, with the insert 28 being securely retained within the head body 12 during prolonged use.

Additional modifications and improvements of the present invention may also be apparent to those skilled in the art. Thus, the particular combination of parts and steps described and illustrated herein is intended to represent only one embodiment of the present invention, and is not intended to serve as limitations of alternative devices within the spirit and scope of the invention.

What is claimed is:

1. A method of manufacturing a golf club head comprising the steps of:

(a) forming a head body from a metal material, said head body defining a front face;

(b) forming a recess within said front face which extends rearwardly within said head body; and (c) casting a curable graphite-epoxy composite within said recess, said composite comprising a laminate having a base layer and a top layer.

2. The method of claim 1 further comprising the step of forming recessed score lines within the top layer during the casting of the laminate.

3. The method of claim 1 further comprising the step of removing residual flash from the perimeter of the recess subsequent to the casting of the laminate into the head body.

4. The method of claim 1 wherein step (b) comprises the step of forming the recess to include an arcuate, generally convex inner surface.

5. The method of claim 1 wherein step (c) comprises the steps of:

(1) placing the laminate into the recess; and (2) curing the laminate within the recess in a manner causing the laminate to be consolidated directly into an integral with the head body.

6. The method of claim 5 wherein step (2) comprises the step of:

placing the head body into a co-curing assembly defining first and second chambers separated by a flexible membrane and including a molding tool movably mounted within said second chamber;

said head body being supported within said second chamber in a manner wherein said molding tool is positioned over said laminate and spaced therefrom.

7. The method of claim 6 wherein step (2) further comprises the steps of:

(i) pulling a vacuum in the first and second chambers while the temperature within the co-curing assembly is at room temperature;

(ii) increasing the pressure in the first chamber to approximately 150 psi while gradually increasing the temperature within the co-curing assembly from room temperature to approximately 250° F., the pressurization of the first chamber to approximately 150 psi facilitating the movement of the molding tool into direct contact with the laminate;

(iii) increasing the pressure in the second chamber to atmospheric pressure while maintaining the temperature within the co-curing assembly at approximately 250° F.;

(iv) gradually decreasing the temperature within the co-curing assembly from approximately 250° F. to room temperature; and (v) decreasing the pressure in the first chamber to atmospheric pressure while the temperature within the co-curing assembly is at room temperature, the depressurization of the first chamber to atmospheric pressure facilitating the movement of the molding tool out of contact with the laminate.

8. The method of claim 7 wherein:

step (i) is conducted for approximately 10 minutes;

step (ii) is conducted for approximately 60 minutes;

step (iii) is conducted for approximately 120 minutes; and step (iv) is conducted for approximately 120 minutes.

9. The method of claim 7 wherein said molding tool includes raised score lines formed thereon and step (2) further comprises the step of forming recessed score lines within the top layer of the laminate, said recessed score lines being formed in the top layer when the raised score lines of the molding tool come into direct contact therewith.

10. The method of claim 6 further comprising the step of removing residual flash from the perimeter of the recess subsequent to the curing of the laminate and the removal of the head body from within the co-curing assembly.

11. The method of claim 5 wherein step (b) comprises the step of forming the recess to include an arcuate, generally convex inner surface.

12. The method of claim 11 wherein step (1) further comprises the steps of:

shaping the base layer to conform to the recess;

inserting the base layer into the recess such that said base layer is in direct contact with the inner surface of the recess;

shaping the top layer to conform to the recess; and inserting the top layer into the recess such that said top layer overlaps and covers said base layer.

13. A method of manufacturing a golf club head comprising the steps of:

(a) forming a head body from a metal material, said head body defining a front face;

(b) forming a recess within said front face which extends rearwardly within said head body, said recess including an arcuate, generally convex inner surface; and (c) casting a curable non-metal insert within said recess.

14. A method of manufacturing a golf club head comprising the steps of:

(a) forming a head body from a metal material, said head body defining a front face;

(b) forming a recess within said front face which extends rearwardly within said head body;

(c) placing a curable non-metal insert into the recess; and (d) curing the insert within the recess in a manner causing the insert to be consolidated directly into and integral with the head body, said curing being facilitated by placing the head body into a co-curing assembly defining first and second chambers separated by a flexible membrane and including a molding tool movably mounted within said second chamber, said head body being supported within said second chamber in a manner wherein the molding tool is positioned over said insert and spaced therefrom.

15. A method of manufacturing a gold club head comprising the steps of:

(a) forming a head body from a metal material, said head body defining a front face;

(b) forming a recess within said front face which extends rearwardly within said head body, said recess including an arcuate, generally convex inner surface;

(c) placing a curable graphite-epoxy composite into said recess, said composite comprising a laminate having a base layer and a top layer; and (d) curing the laminate within the recess in a manner causing the laminate to be consolidated directly into and integral with the head body.

* * * * *